US005365809A

United States Patent [19]

Hsiao

[11] Patent Number: 5,365,809

[45] Date of Patent: Nov. 22, 1994

[54] ADJUSTABLE SPANNER

[76] Inventor: Chia-Yuan Hsiao, No. 4, Lane 11, Tze-Chiang St., Tu-Cheng City, Taipei Hsien, an, Province of China

[21] Appl. No.: 147,484

[22] Filed: Nov. 5, 1993

[51] Int. Cl.[5] ..... B25B 13/10

[52] U.S. Cl. ..... 81/176.3; 81/99; 81/176.1

[58] Field of Search ... 81/99, 125.1, 119, 176.1–176.3, 81/129

[56] References Cited

U.S. PATENT DOCUMENTS 976,391 11/1910 O'Hare ..... 81/176.3 X
3,766,810 10/1973 Romak ..... 81/176.3
4,676,126 6/1987 Polastri ..... 81/176.3

*Primary Examiner*—James G. Smith

*Attorney, Agent, or Firm*—Morton J. Rosenberg; David I. Klein

[57] ABSTRACT

An adjustable spanner includes a connecting member which comprises a center tool hole for inserting a screw-driver for use as a handle, two horizontal openings longitudinally aligned on the same plane at two opposite sides by the center tool hole, two vertical screw holes spaced on the same side and respectively disposed in communication with either horizontal opening; and two symmetrical jaw plates connected parallel to the connecting member and respectively retained in either horizontal opening of the connecting member, having each a plurality of vertical mounting holes spaced in a longitudinal direction and alternatively connected to either screw hole on the connecting member by a respective screw, and side notches bilaterally spaced along the respective length for clamping on the workpiece to be turned.

2 Claims, 4 Drawing Sheets

ADJUSTABLE SPANNER

BACKGROUND OF THE INVENTION

The present invention relates to spanners and more particularly to an adjustable spanner which can be conveniently adjusted into any of a variety of forms for tightening or loosening nuts and bolts of different sizes.

Various spanners have been disclosed, and have appeared on the market. These spanners are commonly gathered into two groups according to their functions, namely, the fixed spanners and the adjustable spanners. A fixed spanner can only turn nuts and bolts of a specific size. An adjustable spanner can be adjusted to turn nuts and bolts of different sizes. However, the adjusting range of a conventional adjustable spanner is still limited to its size. In order to obtain a broad working range, the size of an adjustable spanner must be relatively increased. Increasing the size of an adjustable spanner makes the adjustable spanner inconvenient to carry.

SUMMARY OF THE INVENTION

The present invention has been accomplished under the aforesaid circumstances. It is thereof the principal object of the present invention to provide an adjustable spanner which can be conveniently arranged into any of a variety of forms for tightening or loosening nuts and bolts of different sizes. It is another object of the present invention to provide an adjustable spanner which is easy to assemble and convenient to carry. According to the preferred embodiment of the present invention, the adjustable spanner is comprised of two symmetrical jaw plates connected in parallel to a connecting member by screws. The jaw plates have a respective series of mounting holes alternatively fastened to a respective screw hole on the connecting member. By overturning either or both jaw plates and/or changing the connection between the screw holes on the connecting member and the mounting holes on the jaw plates, the pitch between the jaw plates is changed for turning a workpiece of a different size.

DETAILED DESCRIPTION OF THE PREFERRED EMBODIMENT

Figure 1:
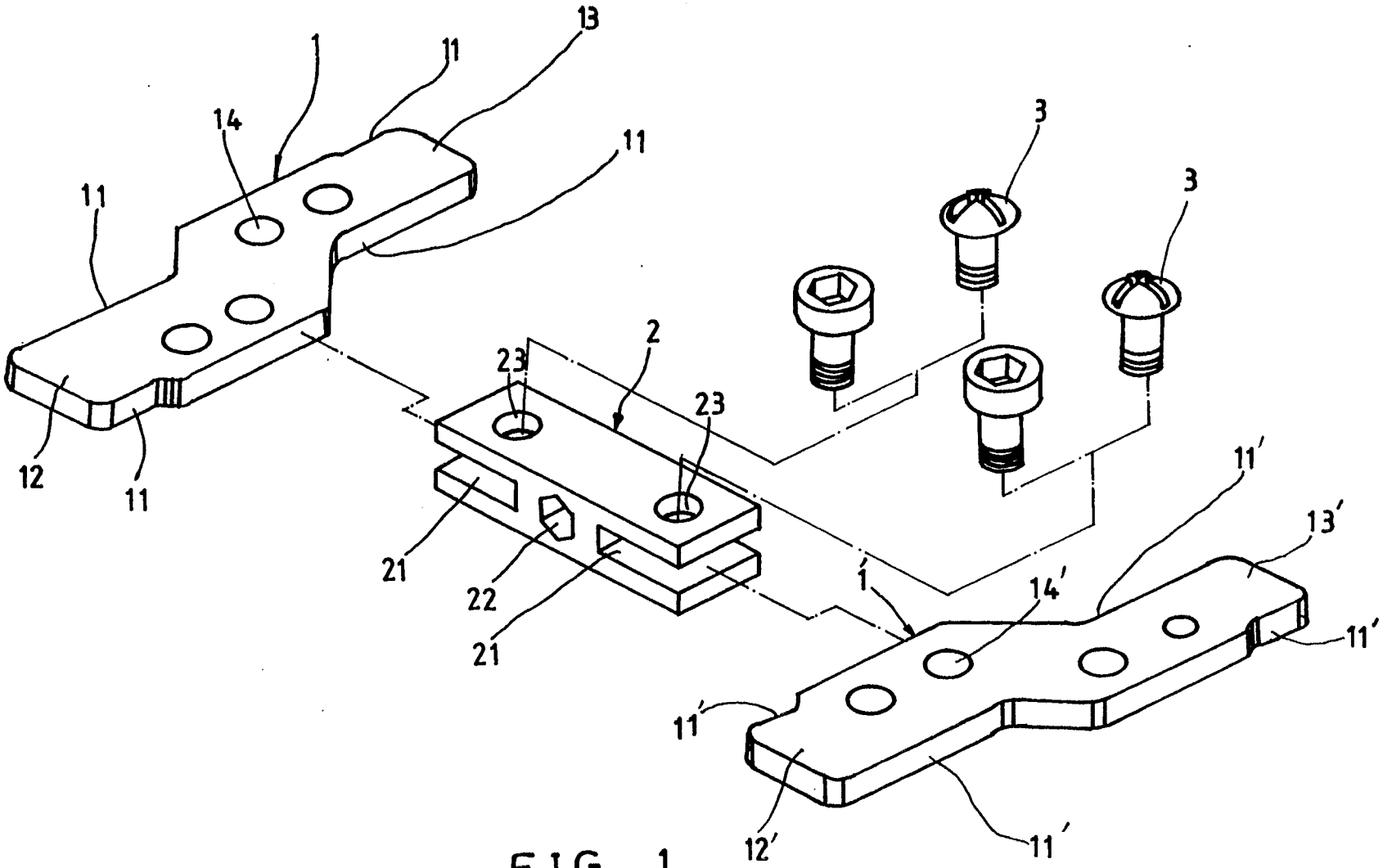
FIG. 1 is an exploded view of an adjustable spanner according to the preferred embodiment of the present invention.
Figure 2:
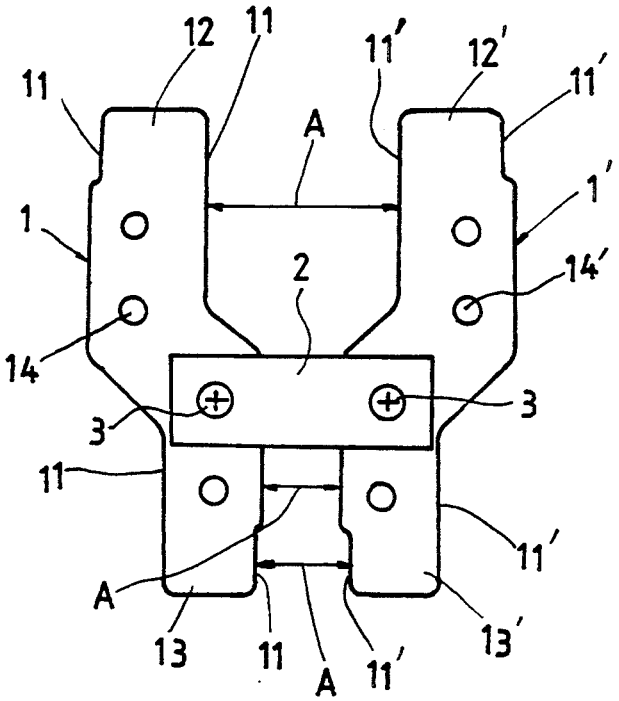
FIG. 2, 2A, 2B, 2C, 2D, 2E shows a set of forms into which the adjustable spanner of FIG. 1 can be alternatively arranged.
Figure 2A:
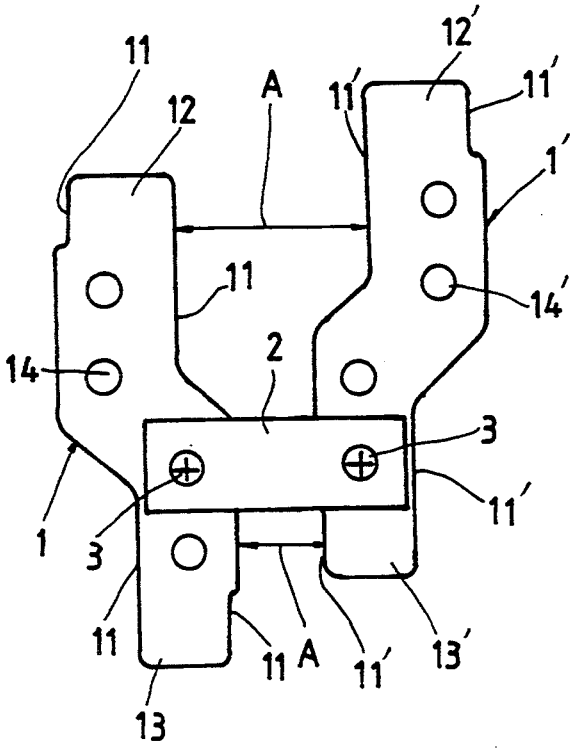
Figure 2B:
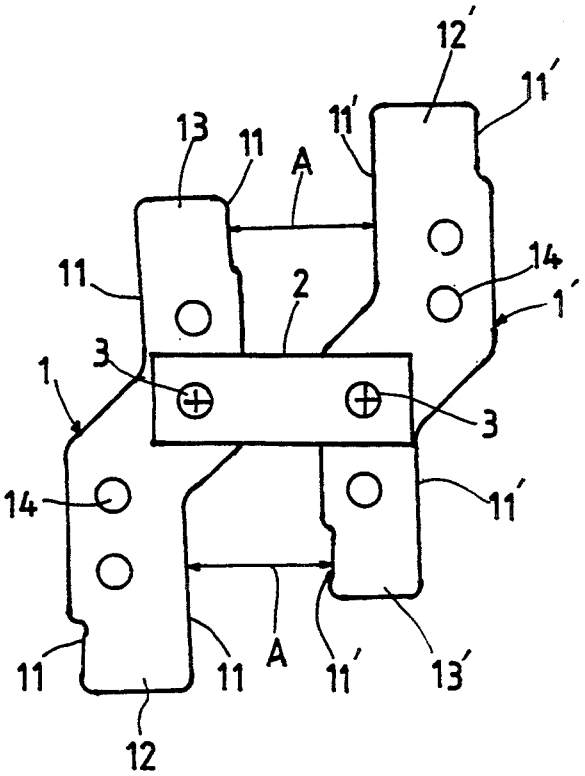
Figure 2C:
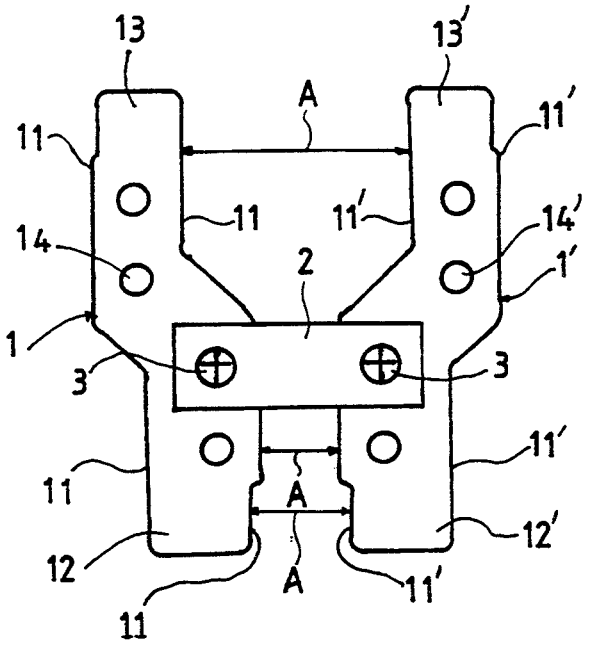
Figure 2D:
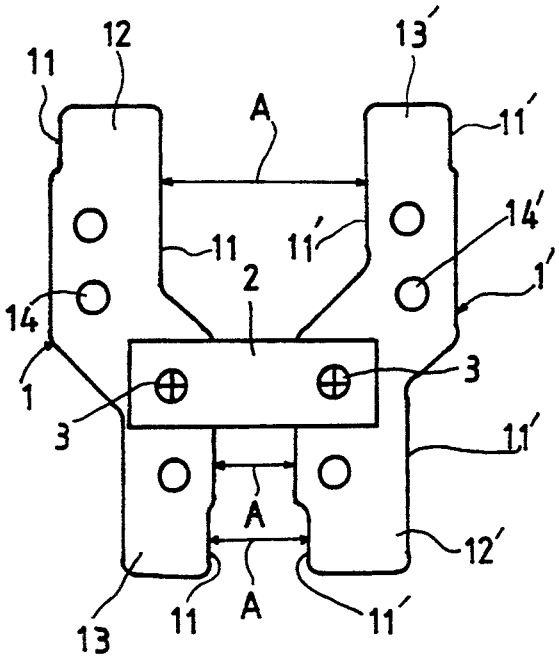
Figure 2E:
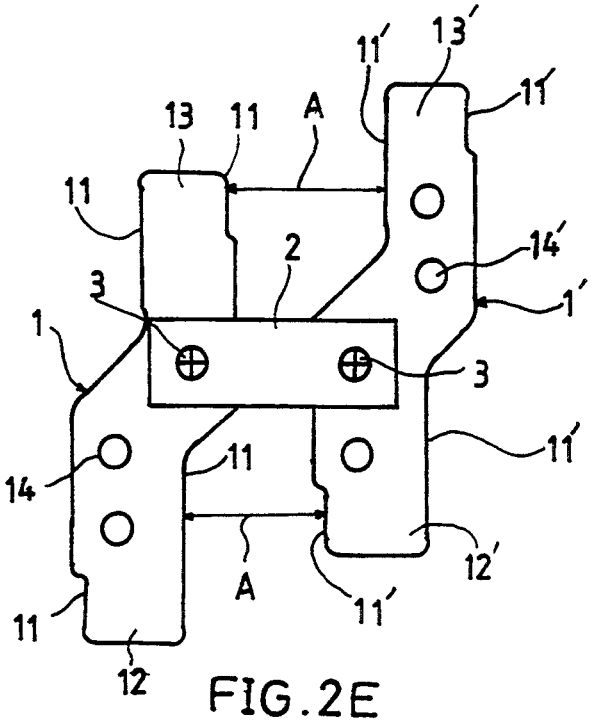

Referring to FIG. 1, an adjustable spanner in accordance with the present invention is generally comprised of a connecting member 2, two symmetrical jaw plates 1;1' connected in parallel to the connecting member 2 at two opposite sides by screws 3. The connecting member 2 is made in a substantially H-shaped configuration comprising a center tool hole 22 through the width, two horizontal openings 21 longitudinally aligned on the same plane at two opposite sides by the center tool hole 22, which receive either jaw plate 1 or 1', two vertical screw holes 23 spaced on one side thereof and respectively disposed in communication with either horizontal opening 21. The jaw plate 1 or 1' comprises a plurality of vertical mounting holes 14 or 14' spaced along the length, side notches 11;11' disposed on two opposite sides of the opposite ends 12;13 or 12';13' thereof. By threading two screws 3 through the screw holes 23 on the connecting member 2 into either mounting hole 14 or 14' on either jaw plate 1;1', the jaw plates 1;1' are connected in parallel to the connecting member 2.

Referring to FIGS. 2, 2A, 2B, 2C, 2D, and 2E, the adjustable spanner can be alternatively arranged into any of a variety of forms for turning workpieces of different sizes. By changing the connection between the connecting member 2 and either jaw plate 1 or 1' from one mounting hole to another or overturning either or both law plates 1;1', the pitch A between either side notch 11 of one jaw plate 1 and a corresponding side notch 11' on the other jaw plate 1', namely the mouth between the jaw plates 1;'1 at either end is changed.

Figure 3:
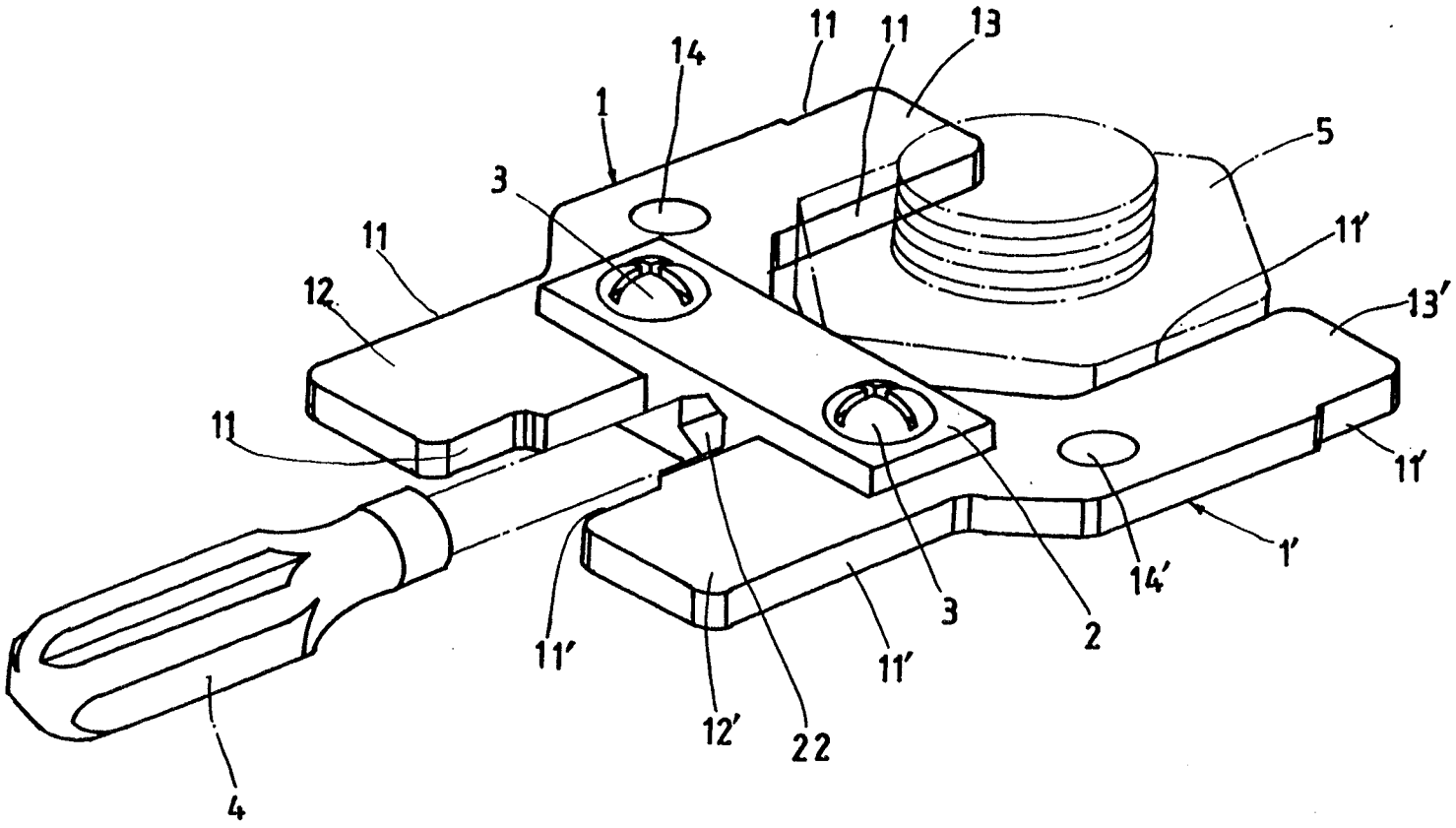
FIG. 3 is an applied view showing the spanner driven by a screw-driver to turn a screw nut.

Referring to FIG. 3, a screw-driver 4 or any rigid elongated rod can be inserted into the center tool hole 22 of the connecting member 2 and used as a handle to drive the adjustable spanner in turning a screw nut 5.

What is claimed is:

1. An adjustable spanner comprising a connecting member which comprises a center tool hole for inserting a screw-driver for use as a handle, two horizontal openings longitudinally aligned on the same plane at two opposite sides by said center tool hole, two vertical screw holes spaced on one side thereof and respectively disposed in communication with either horizontal opening; and two symmetrical jaw plates connected in parallel to said connecting member and respectively retained in either horizontal opening of said connecting member, having each a plurality of vertical mounting holes spaced in a longitudinal direction and alternatively connected to either screw hole on said connecting member by a respective screw, and side notches bilaterally spaced along the respective length for clamping on the workpiece to be turned.

2. The adjustable spanner of claim 1 wherein said side notches are made in different sizes.

* * * * *